United States Patent [19]

Diffrient

[11] 4,429,917

[45] Feb. 7, 1984

[54] CHAIR

[75] Inventor: Niels Diffrient, Ridgefield, Conn.

[73] Assignee: Hauserman Inc. Int. Furniture & Textile Division, Norwalk, Conn.

[21] Appl. No.: 258,760

[22] Filed: Apr. 29, 1981

[51] Int. Cl.[3] ..... A47C 3/00

[52] U.S. Cl. ..... 297/300; 297/304; 297/322

[58] Field of Search ..... 297/300, 301, 304, 305, 297/322, 323, 316, 418, 321

[56] References Cited

U.S. PATENT DOCUMENTS

| | | | |
|---|---|---|---|
| 2,456,797 | 12/1948 | Sheldrick | 297/305 X |
| 2,838,095 | 6/1958 | Deaton | 297/305 |
| 2,859,799 | 11/1958 | Moore | 297/316 X |
| 2,859,801 | 11/1958 | Moore | 297/322 |
| 3,333,811 | 8/1967 | Matthews | 297/300 X |
| 3,337,267 | 8/1967 | Rogers | 297/321 X |

FOREIGN PATENT DOCUMENTS

| | | | |
|---|---|---|---|
| 820791 | 8/1937 | France | 297/321 |

*Primary Examiner*—Francis K. Zugel

*Attorney, Agent, or Firm*—Maky, Renner, Otto & Boisselle

[57] ABSTRACT

A chair of the tilting type which includes a base, a seat and back, with the base pivotally supporting the seat with two opposite non-parallel links of the four bar non-parallel linkage, with one of the opposite links extending to support the back and also being formed to provide an arm rest. The four bar linkage is duplicated on each side of the chair by forming the two opposite non-parallel links or cranks from the upturned ends of the tubes which pass through the base in parallel but vertically offset fashion, the base thus forming the fixed bar of the linkage with its opposite bar or coupler being formed by the seat. A spring within the base is operative on one of the tubes to urge the chair to an upright position. The tubes are pivotally connected to the seat and one of the tubes extends and is fixedly connected to the back in a manner to emphasize the isolated and separate appearance of the seat and back. With the above construction the seat and back both tilt in their proper natural body support positions but in a respective ratio of about 1 to 3. The chair thus obviates some of the problems of prior chairs where only the back tilts or both the seat and back tilt as a unit.

16 Claims, 10 Drawing Figures

CHAIR

This invention relates generally as indicated to a chair and more particularly to a chair of the tilting type.

BACKGROUND OF THE INVENTION

Tilting type chairs commonly used in offices usually provide for the back to tilt alone or for the seat and back to tilt as a unit. If the back alone pivots, it generally creates a problem known as "shirt tail pull." This problem is usually accentuated by the tendency of the hips of the user to slide forward as the back tilts rearwardly.

In chairs where both the seat and back tilt as a unit, in the tilted position there is a tendency to lift the legs of the user from the floor creating an undue pressure by the forward edge of the seat against the underside of the legs of the user immediately above the knee. To overcome this problem the user may then slouch forward in the chair again creating a shirt tail pull. Also, such chairs generally require the user to lift the feet from the floor to restore the chair to its upright position.

In any tilting chair, it is desirable that the tilt pivot point be at the center of the body or where the body back normally pivots. The pivot point should normally be struck from the ideal point. It is also desirable to have a chair wherein both the seat and back tilt but wherein the seat tilts to a lesser but proportionate degree to the back. It is, of course, also desirable to provide a chair wherein the user does not have to lift the feet to restore the chair to its upright position and which avoids the common shirt tail pull problem.

It is also desirable to provide a chair which is of simplified construction and yet of clean, pleasing appearance emphasizing the isolated and separate appearance of the seat and back with respect to the supporting frames.

SUMMARY OF THE INVENTION

With the present invention, a tilting chair is provided wherein the seat back pivot is effectively at the ideal point and which obviates the problems of shirt tail pull and feet lift common in prior art chairs. Moreover, with the present invention, a chair is provided in which both the seat and back are supported from the base by a linkage mechanism which permits the tilting of the back to a greater yet proportionate degree to the seat.

This proportionate tilting of the seat and back is achieved with a four bar non-parallel linkage. With such linkage the seat is supported on each side by two opposite non-parallel links or cranks of the four bar linkage with one of such opposite links on each side extending to support the back and also being formed to provide an arm rest. The linkage is duplicated on each side of the chair by forming the two opposite non-parallel links from the upturned ends of rods or tubes which pass through the base in parallel but vertically offset fashion, the base thus forming a fixed bar of the linkage with its opposite bar or coupler being formed by the seat frame.

The pivots of the linkage are designed so that the body weight tends to balance the seat pivot and a spring within the base is operative on one of the bars of the linkage to urge the chair to an upright position, simply to overcome the body weight.

The bars of the linkage on each side of the chair are pivotally connected to the seat and the extended bar is fixedly connected to the back in a manner to emphasize the isolated and separate appearance of the seat and back.

The base spaced below the seat is of relatively small clean and compact construction housing the journals for the noted parallel but vertically offset bars or tubes. In addition, the base houses the spring and a vertical height adjustment mechanism.

It is a accordingly a principle object of the present invention to provide a tilting chair which includes a base, seat and back with means interconnecting the base, seat and back to permit tilting or pivoting of the back to a greater degree than the seat.

Another principle object is the provision of such chair wherein the back and seat are supported for rearward pivoting movement with respect to the base in a pivot ratio of back-to-seat greater than 1 and preferably about 3 to 1.

It is also an important object of the present invention to provide a tilting chair which eliminates the common problems of shirt tail pull and foot lift of prior art chairs.

Another important object is the provision of a tilting chair wherein the back is theoretically pivoted to the seat at or in alignment with approximately the ideal pivot point of the body of a user.

An object is also the provision of a tilting chair wherein the base pivotally supports the seat from two opposite non-parallel links of a four bar non-parallel linkage.

A further object is the provision of such chair wherein one of the opposite links on each side of the chair extends to support the back, such link also being formed to provide an arm rest.

A yet further object is the provision of a chair wherein the four bar linkage is duplicated on each side of the chair by forming the two opposite non-parallel links from the upturned ends of the rods or tubes which pass through the base in parallel but vertically offset fashion.

Another object is the provision of such chair wherein the base forms a fixed bar of the linkage with the opposite bar being formed by the seat.

Still another important object is the provision of a tilting chair wherein the linkage supporting the seat and back is substantially balanced by the body weight of the user.

Yet another object is the provision of such chair wherein a spring in the compact base acting on one of the bars of the linkage is operative to urge the chair to an upright position overcoming the body weight of the user.

A yet further object is the provision of a tilting chair wherein the frame supporting the seat and back are pivotally connected to the seat and fixedly connected to the back in a manner to emphasize the isolated and separate appearance of the seat and back.

These and other objects and advantages of the invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
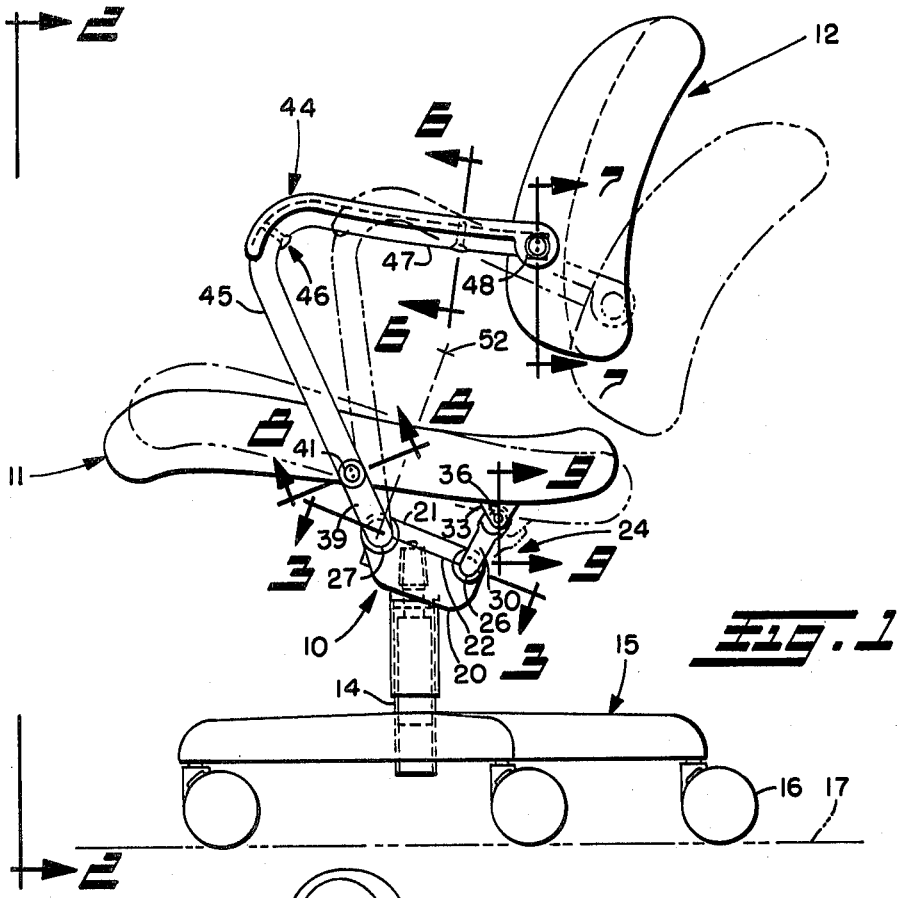
FIG. 1 is a side elevation of a chair in accordance with the present invention illustrating in full lines the seat and back in upright position and in phantom lines the seat and back in tilted position.

Referring first to FIG. 1, it will be seen that the chair comprises a base 10, a seat 11 and a back 12. The base 10 is supported on pintle 14 projecting upwardly from the center of five-legged pedestal 15, the ends of the legs accommodating casters 16 supporting the chair on floor 17.

The base 10 comprises a somewhat inclined two-part housing with the lower part of the housing being seen at 20 and the upper or cover part being seen at 21. The two housing parts mate on the inclined plane 22 which is the same plane as formed by the section 3—3.

The seat 11 is supported from the base by a four bar non-parallel linkage seen generally at 24. The linkage is, in effect, repeated on each side of the chair and the bottom bar of the linkage is fixed and formed by the base 10. The top or non-parallel link opposite the fixed link of the base is formed by the frame of the seat 11 while the fore and aft opposite non-parallel links are formed by the upturned ends of horizontally extending parallel rods or tubes 26 and 27 which extend in such parallel fashion horizontally through the base 10.

It is noted that the tube 26 to the rear of the chair is offset vertically below the tube 27 and its upturned ends 29 and 30 form the rear non-parallel links of the four bar linkage. Such upturned ends are pivotally connected to the depending tabs 33 which are secured to upturned shoulder edge 34 of the seat frame 35, as seen more clearly in FIG. 9. The pivotal connection is shown at 36 in FIG. 1.

The upturned ends 29 and 30 of the tube 26 are relatively more closely spaced than the upturned ends 38 and 39 of the tube 27. Such more widely spaced upturned ends 38 and 39 form the front non-parallel link of the four bar linkage 24 opposite the link 30. Such upturned ends 38 and 39 extend outside of the seat 11 and are pivotally connected to the frame of the seat at 40 and 41, respectively. The detail of the pivot connection is seen more clearly in FIG. 8.

The seat frame between the pivot connections for the upturned ends of the tubes 26 and 27 forms the fourth linkage or coupler of the four bar linkage 24.

The upturned ends 38 and 39 of the tube 27 extend beyond the pivots 40 and 41 to form arm rests seen at 43 and 44. The upturned tubes extend linearly forwardly as seen at 45 and are bent to an acute angle through the radius 46 to extend linearly rearwardly slightly inclined as seen at 47. The distal ends of the arms are fixedly connected at 48 to the frame 49 of the back cushion 12, as seen in greater detail in FIG. 7 or 10. The back cushion is thus supported in cantilevered fashion between the distal ends of the upturned and rearwardly bent ends of the tube 27.

It is noted that the upturned ends of the front and rear tubes extend upwardly and away from each other to form an upwardly opening V. The ideal back pivot point of the user shown at 52 in FIG. 1, will be on a line substantially bisecting such V or slightly forward thereof so that the body weight tends to balance the seat pivot. Also, such ideal back pivot point is aligned with the back pivot which is the horizontal axis of the tube 27, such alignment being substantially normal to the line between the seat pivots 41 and 36. The positioning of the various pivot points with respect to the ideal back pivot of the user not only tends to balance the seat pivot but also to minimize the restorative forces required in returning the seat and back to its upright position.

Figure 3:
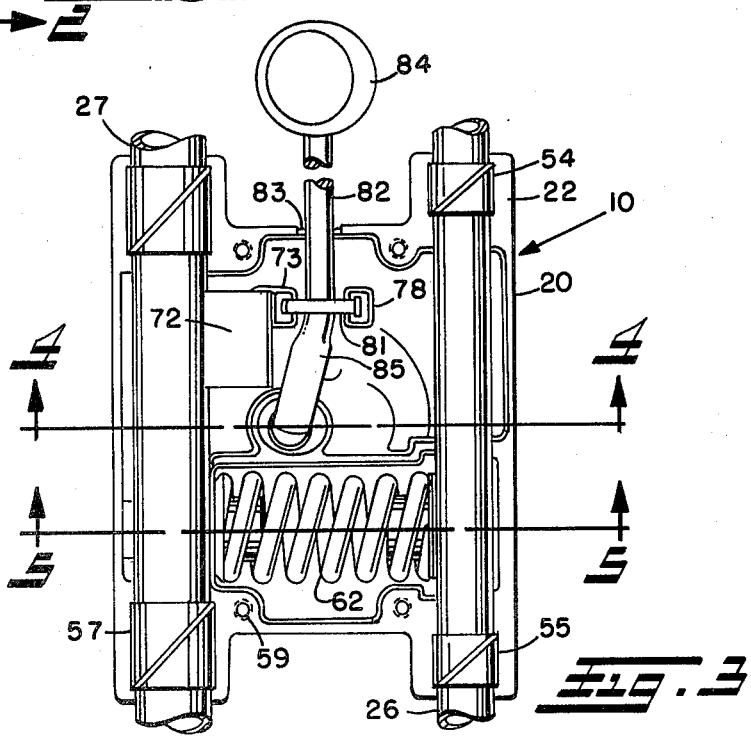
FIG. 3 is an enlarged section of the base taken substantially on the line 3—3 of FIG. 1.
Figure 4:
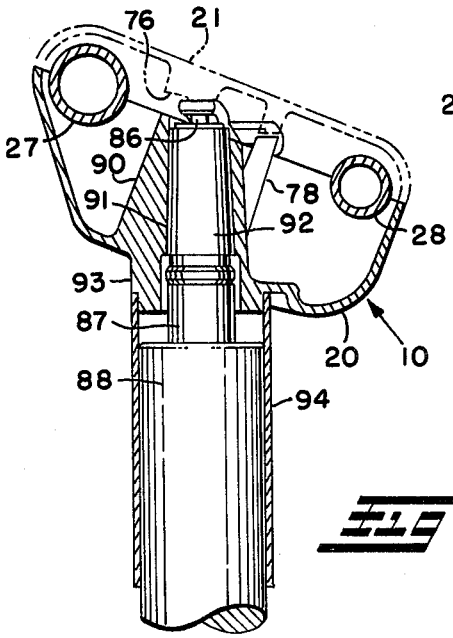
FIG. 4 is a vertical section of the base taken substantially on the line 4—4 of FIG. 3.
Figure 5:
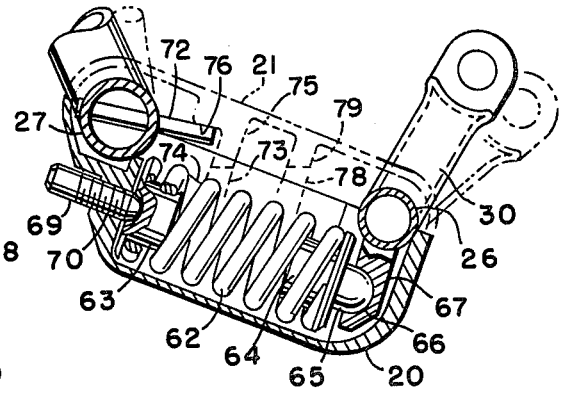
FIG. 5 is a vertical section of the base taken substantially of the line 5—5 of FIG. 3.

Referring now to FIGS. 3, 4 and 5, it will be seen that the horizontal portion of the tubes 26 and 27 are mounted in nylon or like self-lubricating plastic sleeve bearings seen at 54 and 55 for the somewhat smaller rear and lower tube 26, and at 56 and 57 for the somewhat larger forward and upper tube 27. The cover 21 of the base secures the tubes and the sleeve bearings in place when secured to the housing 20 by suitable fasteners, not shown, extending into the tapped holes 59.

In the housing is a fairly large, yet completely enclosed, compression spring 62, the axis of which is parallel to but offset below the plane between the axes of the horizontal portions of the tubes 26 and 27. The spring extends between an upper spring plug 63 and a lower spring plug 64, the latter being provided with a projecting rounded nose or ball 65 engaging ball socket 66 and arm 67 secured to and projecting downwardly from the tube 26. The opposite spring plug 63 mates with the inner end of spring adjustment screw 69 which is threaded in tapped hole 70 in the housing 20. As seen the threads are omitted on the forward end of the screw to prevent overtightening of the spring. The outer end projects through the housing. Thus the projecting end of the screw 69 may be employed to adjust the pressure of the spring which tends to pivot the horizontal tube 26 in a counterclockwise direction as viewed in FIG. 5 to restore the chair to its upright position.

In order to limit tilting in both directions, the somewhat larger tube 27 is provided with a projecting stop key 72. The stop key may extend diametrically through the tube 27 and is secured thereto as by welding. As seen more clearly in FIG. 5, the housing 20 may be provided with a projection 73 which includes a stop surface 74 projecting toward the tube 27. Similarly, the cover 21 is provided with a mating projection 75 also including projecting stop surface 76 extending toward the tube 27. The two angularly related stop surfaces 74 and 76 limit the pivoting movement of the tube 27 about its own axis to approximately 17°. With the geometry of the illustrated four bar linkage such pivoting movement of the tube 27 and thus the back cushion 12 concurrently and proportionately tilts the seat about 6° and 45 minutes or in an approximate 3 to 1 ratio.

In addition to the projections 73 and 75 in the housing 20 and cover 21, respectively, there are also projections 78 and 79, which paired projections mate in a horizontal plane. The facing surfaces of such projections may be provided with mating recesses accommodating the opposite ends of transverse pivot 81 of lever 82. The outer end of the lever projects through mating recesses in the housing and cover as seen at 83 and is provided with an actuating knob 84. The inner end of the lever is laterally and vertically offset as seen at 85 and engages bypass valve button 86 on top of plunger 87 of gas spring lifter 88 which is part of the upwardly extending pintle of the pedestal. Thus lifting the knob 84 will depress the valve button 86 permitting the chair to be readily height adjusted. To accommodate the plunger of the gas spring lifter, the housing 20 is provided with an enlarged upwardly extending boss 90 which has a slightly tapered hole 91 therein which may accommodate split sleeve adapter 92, supporting the base 10 on the gas spring plunger.

The housing also includes a downwardly extending boss 93 to which is secured the upper end of appearance sleeve 94. It will also be appreciated that other commercially available height adjustment mechanisms may readily be employed.

Figure 2:
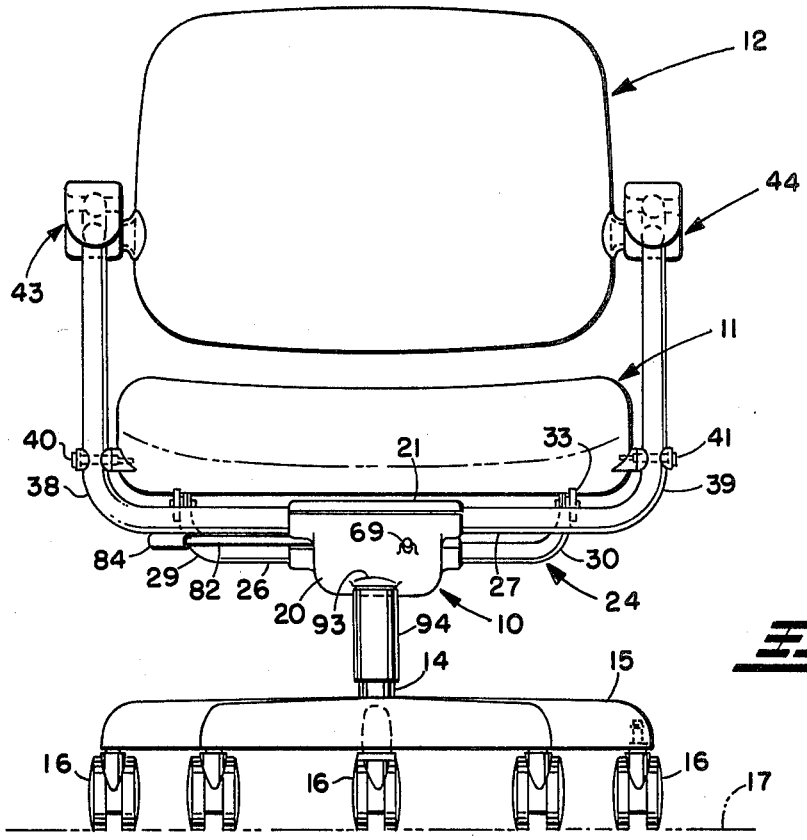
FIG. 2 is a front elevation of the chair as seen from the line 2—2 of FIG. 1.

From FIGS. 1 and 2 it will be apparent that the seat and back have a clean isolated or separated and almost unsupported appearance. This is achieved in large part by the noted four bar linkage and its relatively few or at least concealed connections to the seat and back.

Figure 7:
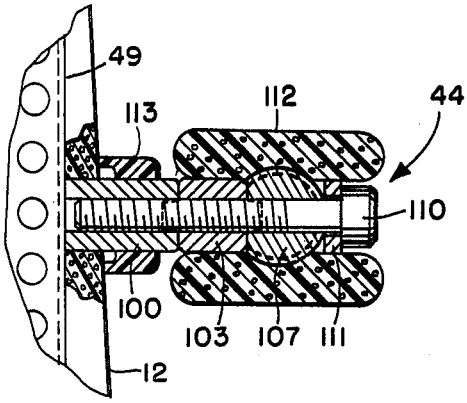
FIG. 7 is a similar section on a slightly reduced scale taken through the link-back connection on the line 7—7 of FIG. 1.
Figure 10:
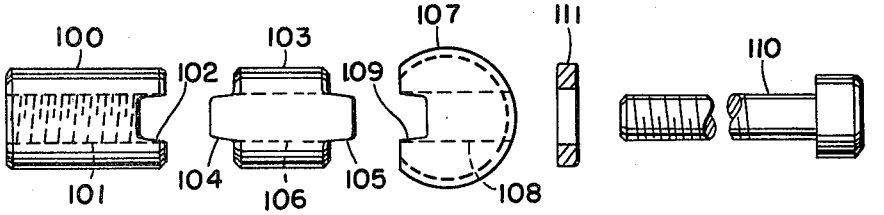
FIG. 10 is an exploded view of the link-back connection seen in FIG. 7.

Referring now additionally to FIGS. 7 and 10, it will be seen that the horizontal portion 47 of the tube 27 which forms the arm rest is connected to the frame 49 of the back cushion 12 by the assembly shown. A lug 100 is secured as by welding to the flanged edge of frame 49 and is provided with a tapped hole 101. The outer end face includes a transverse slot 102. A bushing 103 with oppositely directed transverse keys 104 and 105 includes a blind hole 106. Situated within the end of tube 27 is circular shouldered bushing 107 which also includes blind hole 108 and transverse keyway 109. A stripper bolt 110 extends through washer 111, bushing 107, bushing 103 and is threaded in lug 100. The key and slot connections set the angle of the back with respect to the arm.

Figure 6:
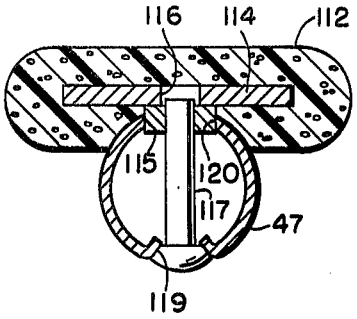
FIG. 6 is an enlarged section through the extended link forming the chair arm rest taken substantially on the line 6—6 of FIG. 1.

Extending between the back cushion or its fabric cover and foam arm cap 112 is a lug cover 113. The arm cap may be made of self-skinning foam and is wrapped around the attachment end of the arm to the back and is secured to the top of the arm along the horizontal reach thereof. As indicated in FIG. 6, the foam cap may be provided with a metal insert 114 secured to weld nut 115. The insert is provided with a clearance hole 116 into which the end of fastener 117 may project. The fastener is of the oval head type and the head fits within the counter sunk hole 119 while the weld nut fits within a somewhat larger diametrically opposed hole 120. Several such fasteners may be employed to secure the pad in place along the top of the arm rest and the pad may extend slightly around the exterior of the curve 46 as seen in FIG. 1.

Figure 8:
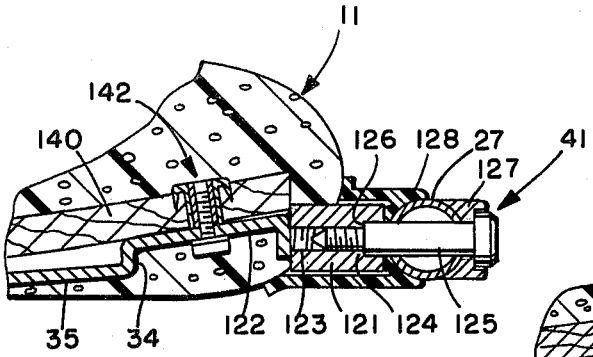
FIG. 8 is a similar section through the link-seat connection seen from the line 8—8 of FIG. 1.

Referring now to FIG. 8, it will be seen that the pivot 41 is obtained by a pivot lug 121 which is secured to flanged lateral extension 122 of seat frame 35. The lug 121 is provided with a tapped hole 123. The hole is provided with a shoulder 124. A shoulder stripper bolt 125 is provided with shoulder 126 which seats against the shoulder 124. The head of shoulder bolt 125 seats in a recess of ferrule 127 between the head and tube 27 and extends through diametrically opposed holes in the tube and into the lug 121. A urethane cover of grommet 128 extends between the tube and seat cushion 11 enclosing the projecting lug 121.

Figure 9:
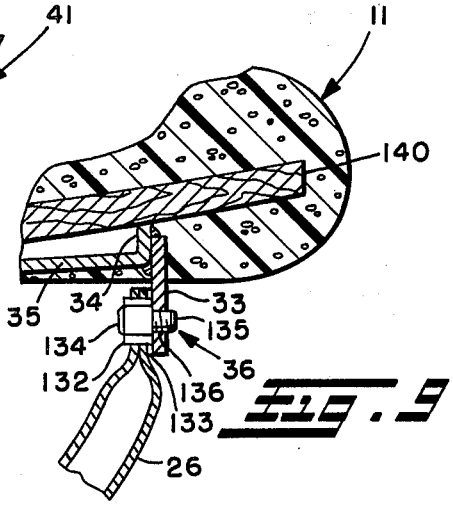
FIG. 9 is a section taken through the opposite non-parallel link connection to the seat as seen from the line 9—9 of FIG. 1.

Referring now to FIG. 9, it will be seen that for the tube 26 the upturned ends 30 are simply flattened and provided with aligned holes to accomodate in a press fit fashion a flanged sleeve bearing 132 with the flange 133 thereof acting as a thrust washer between the flattened tube ends and tab 33. The bearing rides on the enlarged diameter of shoulder pin 134 which includes a reduced diameter threaded stud 135 secured into tapped hole 136 in tab 33 with lock threads. At least the back cushion may be formed by poured-in-place polyurethane over the internal frame.

It is noted that the seat cushion includes a molded wood or the like pan 140 which may be secured to the frame 35 by the biting or gripping fasteners shown at 142 which extend through the lateral extensions 122.

It can now be seen that there is provided a chair of compact, clean, and simplified design utilizing a simplified linkage support system which is duplicated on each side of the chair and which utilizes the base and seat frame. The result is a chair wherein the seat and back both tilt but the seat tilts proportionately to a lesser degree. The preferred ratio of the seat-to-back tilt is approximately 1 to 3.

In any event, the chair permits the user to keep the feet on the floor and allows the back angle to recline for added comfort. The somewhat lesser incline to the seat avoids the sliding out feeling and restrains the body from sliding forward and avoids shirt tail pull. The chair will recline with back force only and if such force is relieved the chair will tend to return to its upright position without lifting the feet or legs from the floor.

The chair of the present invention finds particular utility in office or task seating.

I claim:

1. A chair comprising a seat, a back, a four bar linkage, said linkage including a base, said seat forming a second link of said linkage, said linkage including a third link having one end portion pivotably connected with a rear portion of said base and an opposite end portion pivotably connected with a rear portion of said seat, a fourth link having a first end portion pivotably connected with a forward portion of said base and a second end portion pivotably connected with a forward portion of said seat, and means for mounting and fixing said back to said fourth link for pivoting movement together with said fourth link about said pivotable connection between said fourth link and said base.

2. The chair of claim 1 wherein said means for mounting said back includes an extension of said fourth link.

3. The chair of claim 2 further including an arm rest formed by said fourth link.

4. The chair of claim 3 wherein said arm rest is formed by a horizontal portion of said fourth link.

5. The chair of claim 4 wherein said third and fourth links are formed by upturned portions of tubes.

6. A chair as set forth in claim 5 wherein said tubes extend horizontally parallel to each other beneath the seat and are journalled for rotation about their axes within said base.

7. A chair as set forth in claim 6 wherein the fourth link forming tube is journalled in said base at a higher elevation than the third link forming tube.

8. A chair as set forth in claim 7 wherein the upturned portions of the third link forming tube are pivotally connected to said seat therebeneath.

9. A chair as set forth in claim 7 wherein the upturned portions of the fourth link forming tube are pivotally connected to the sides of the seat.

10. A chair as set forth in claim 9 wherein the upturned portions of the fourth link forming tube extend upwardly and then rearwardly to form arm rests.

11. A chair as set forth in claim 10 wherein said back is isolated from the seat and is fixedly connected between the distal ends of the fourth link forming tubes.

12. A chair as set forth in claim 6 including a spring in said base operative to return the seat and back to an upright position.

13. A chair as set forth in claim 12 wherein said spring is a compression spring urging the third link forming tube to rotate in a direction to move the seat and back to an upright position.

14. A chair as set forth in claim 1 wherein the back and seat tilt ratio is greater than one.

15. A chair as set forth in claim 14 wherein such ratio is about 3 to 1.

16. A chair as set forth in claim 1 wherein said back supporting means is part of said linkage, and the seat and back are isolated from each other and supported solely by said linkage.

* * * * *